United States Patent [19]

Kraus et al.

[11] Patent Number: 4,788,752

[45] Date of Patent: Dec. 6, 1988

[54] MOLDED PLASTIC BINDING STRAP

[75] Inventors: Willibald Kraus, Grünstadt; Marita Kloster, Enkenbach; Jürgen Hofmann, Eisenberg, all of Fed. Rep. of Germany

[73] Assignee: TRW United-Carr GmbH, Alsenborn, Fed. Rep. of Germany

[21] Appl. No.: 134,379

[22] Filed: Dec. 17, 1987

[30] Foreign Application Priority Data

Dec. 19, 1986 [DE] Fed. Rep. of Germany ..... 3643641

[51] Int. Cl.[4] ..... B65D 63/00

[52] U.S. Cl. ..... 24/16 PB; 24/17 AP

[58] Field of Search ..... 24/16 PB, 17 AP, 30.5 P; 248/74.3; 292/318

[56] References Cited

U.S. PATENT DOCUMENTS

| | | | |
|---|---|---|---|
| 2,979,794 | 4/1961 | De Bartolo | 24/16 PB |
| 3,488,813 | 1/1970 | Kohke | 24/16 PB |
| 3,983,603 | 10/1976 | Joyce | 24/16 PB |
| 4,001,898 | 1/1977 | Caveney | 24/16 PB |
| 4,263,697 | 4/1981 | Speedie | 24/30.5 P |
| 4,501,049 | 2/1985 | Adamson | 24/17 AP |

*Primary Examiner*—Victor N. Sakran

*Attorney, Agent, or Firm*—Fay, Sharpe, Beall, Fagan, Minnich & McKee

[57] ABSTRACT

A plastic or cable tie band element for clasping, holding and bundling of objects comprises a profiled band part 6 having a head part 1 joined thereto. Extending through the head part is a passage opening 8 for receiving the band part 6. A holding projection 2 is provided in the opening 8 for cooperating with the profile of the band part 6 and retaining it in the opening. Also within the opening 8 and lying opposite the holding projection is at least one guide element. The guide element comprises at least one rigidly designed knob part 3 provided with a guide track 7 for the band part 6. The guide element is located relative to the introduction direction A of the band part 6 such that it is displaced to the side and at a distance behind the holding projection 2. This causes the band part 6 to move into engagement with the holding projection 2 during insertion or attempted removal of the band part 6.

3 Claims, 2 Drawing Sheets

MOLDED PLASTIC BINDING STRAP

BACKGROUND OF THE INVENTION

The subject invention relates to a one piece plastic binding strap or cable tie which comprising a stop head part and a ladder-like band part. The head part has a passage opening with an internal holding projection adapted to engage in the profile of the band part. Lying opposite the holding projection is a guide element provided with a guide track for the band part.

Broadly, such a binding strap is known in the prior art. U.S. Pat. No. 3,488,813 shows a strap in which a holding projection is formed in the lower zone of the head part. The upper zone of the holding projection, in the band introduction direction, lies against an oblique surface in the head part and is pressed back in the opposite direction during the introduction of the band to be held. The guide track lies opposite the holding projection and is arched in the beginning zone and directly joins to an oblique track section. In this structure, only the portion of the holding projection projecting into the guide channel is effective in holding the band. The band part, during the mounting and during the holding, remains in the same plane in the head part. The use of this binder requires some skill because of its elaborate structure.

The prior art also includes a binder strap with a guide channel passing through a head, which has two side channels, lying opposite each other. See, for example, West German Patent No. 2,328,955. In the closed position, through the action of the band part, the elastic holding projection is pressed against a back wall of a side channel, by which the closing position is effected. This known construction is elaborate to build and requires, for the holding of the band part, the contact of the holding projection against the wall of a side channel. Thus, a pull on the strap must constantly be present in order to assure the maintenance of the closing position.

U.S. Pat. No. 4,001,898 shows a band element which is so designed that the holding projection is a rigid element, which in the passage direction lies opposite an elastic guide element. Here, the holding projection and the guide element have the same width. In introducing the band part into the passage opening, the elastic guide element is first pressed back until the band part lies, in the closed position, against the rear zone of the rigid holding projection. The guide element in this known construction can swing and has, to its disadvantage, a weak place precisely in the swinging zone. Thus, the life of this known construction is considerably reduced. Moreover, the band part is only partially guided during the mounting, so that again, some skill is required to carry out a perfect mounting.

SUMMARY OF THE INVENTION

The subject invention overcomes the noted problems and provides a binder strap which with simple structure makes possible a rapid mounting and which holds the band part, free of damage, inside the head part. As a result the arrangement should have a long life.

In particular, according to the invention, the holding projection includes a rigid holding zone and an elastic band-guiding zone. An associated guide element is formed by rigid knobs or protrusions which are located to the side and at a distance behind the elastic band-guiding zone of the holding projection.

With this structure, it is possible, even without expertise, to introduce the band part quickly and simply into the passage opening, and to hold it through the holding projection. Neither the holding projection nor the knob part is under a harmful load, even with alternating stresses.

Preferably, and in accordance with a more limited aspect, the elastic band-guiding zone of the holding projection is directed diagonal toward the guide plane of the knobs. In the viewing direction of the passage opening, the elastic band-guiding zone of the holding projection projects, in a manner known per se, between the guide tracks of the knobs. Moreover, the distance of the two knobs from each other may correspond approximately, in a manner known per se, to the distance of the lengthwise stays of the band part. In this way, the band part is given perfect guiding during the threading into the passage opening and no expertise is needed for carrying out the mounting.

The above and other objects and advantages will become apparent from the following description when read in conjunction with the accompanying drawings wherein.

DETAILED DESCRIPTION OF THE PREFERRED EMBODIMENT

Figure 1:
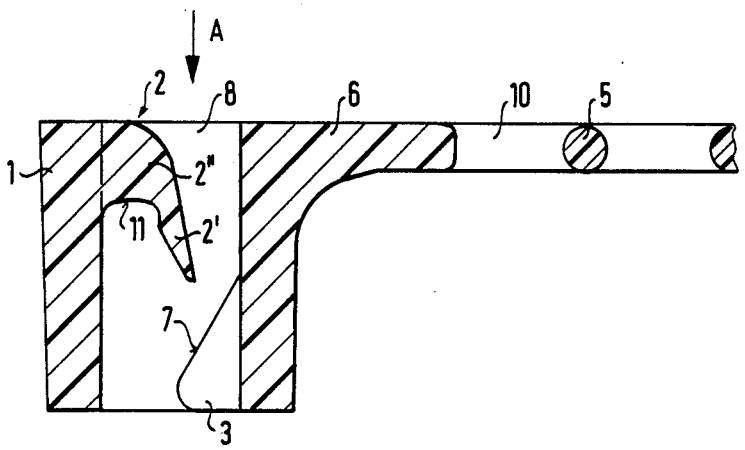
FIG. 1 is a cross-sectional view taken on line I-I of FIG. 2.

Referring more particularly to the drawings wherein the showings are for the purpose of illustrating a preferred embodiment of the invention only, and not for the purpose of limiting the same, FIG. 1 shows the strapping band or cable tie element as being molded from a suitable plastic and intended for clasping or wrapping around, holding and bundling objects. Broadly, it essentially includes a head part 1 and a band part 6 integrally jointed thereto. The band part 6 may have a ladder-like design with a series of relatively uniformly spaced openings 4 (see FIG. 2) defined by laterally spaced, lengthwise stays 9 and 10 and transverse ladder steps or cross members 5. It should be appreciated that the band part 6 is shown only partially and that its actual length would depend upon the maximum circumference of the bundled objects with which it is to be used.

The head part 1 is provided with a band receiving passage opening 8, which extends therethrough. In this passage opening, in the direction of introduction A of the band part 6, there is first of all, a holding projection 2 which consists of tapered flexible and elastic front zone 2' and a rigid relatively inflexible rear zone 2'. Here, the rigid rear zone 2'' is adapted, by its rounding 11 to the cross-sectional form of the ladder rung or cross members 5.

The holding projection 2 projects by its elastic front zone 2' in the direction of a guide element comprising a knob part of protuberance 3 which lies diagonally opposite. This knob part 3 has a top surface which defines a guide track 7 (See FIG. 1). From FIG. 2 it can be seen that the guide element is comprised of two individual knob parts, 3' and 3', which have, in each case, the above-mentioned guide track 7. Looking at the passage opening 8 inwardly from FIG. 2 it will be seen that the elastic front zone 2' of the holding projection projects between the guide tracks 7 of the two individual knobs 3' and 3'.

Figure 2:
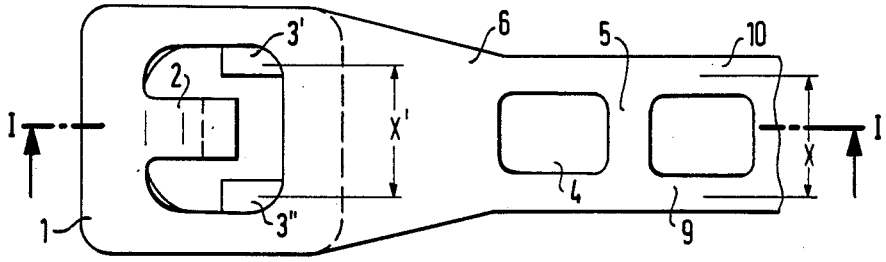
FIG. 2 is a top view of a strapping band formed in accordance with a preferred embodiment of the invention (only part of the band portion is shown)

In addition, the arrangement of the individual knobs 3' and 3' is such that the distance X' corresponds approximately to the distance X of the two lengthwise stays 9 and 10, as best seen in FIG. 2. Also, the width of opening 8 is preferrably only slightly wider than the width of band part 6.

Figure 3:
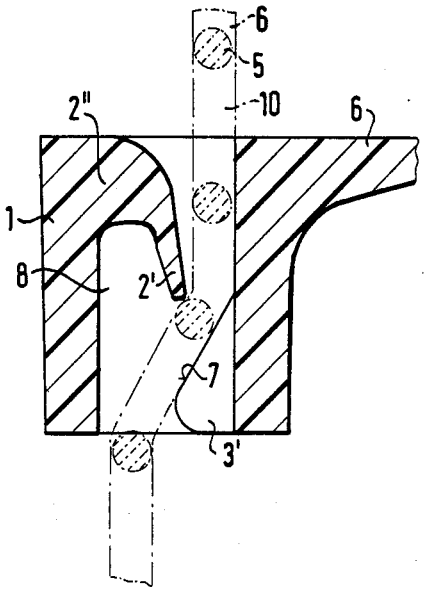
FIG. 3 is cross a cross-sectional view showing the band portion of the strapping band of FIG. 2 being inserted into the head portion; and, FIG. 4 is a cross-sectional view similar to FIG. 3 but showing the band portion in its connected position in the head portion.
Figure 4:
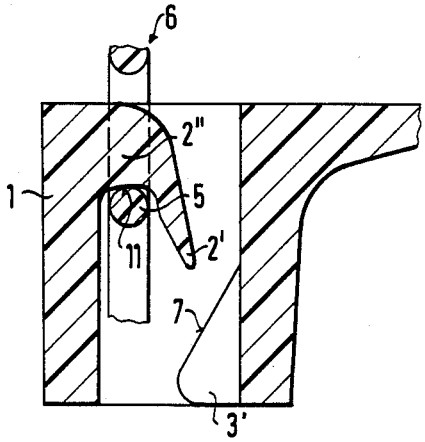

For assembly of the band part 6 into the head part 11, the band part 6 is pushed, as shown in FIG. 3, in the introduction direction A into the passage opening 8. As the band part 6 moves into the opening the elastic front zone 2' of the holding projection 2 is pressed back, and the band part 6 is biased toward the knobs 3' and 3'. In this way, the lengthwise stays 9 and 10 are given a guiding, as shown in FIG. 3, on the guide tracks 7 of the two individual knobs 3' and 3'. This process takes place until the objects to be bundled are sufficiently bound together. Then a slight reverse tension or pulling on the band part causes it to slide into the rounding 11 of the rigid rear zone 2" of the holding projection 2, so that a situation according to FIG. 4 results. In this condition, a ladder step 5 lies against the rounding 11 of the rigid zone 2" of the holding projection 2; with this, the mounting or connecting is completed. If necessary, for the demounting or disconnecting, the ladder-like band part 6 may be unhooked from the rigid zone 2" of the holding projection 2, by holding the elastic front zone 2' in the deflected position of FIG. 3 and sliding the band part 6 over the guide tracks 7 of the two individual knobs, 3' and 3', to move out of the head part 1, against the introduction direction A.

The whole arrangement is simply constructed, and the band part is given a perfect guiding in mounting, so that no expertise is needed for this. On the other hand, in the closed position, the band part is perfectly locked in the rigid zone of the holding projection 2, and is thus able to hold the bound objects, even with alternating load. These bound objects may be, for example, cable or wire in a motor vehicle or pipe bundles. In the field of the auto industry, it is important to assure, in this way, a rapid and simple mounting, and, on the other hand, to assure a secure holding of the bound and tied objects.

The invention has been described with reference to a preferred embodiment. Obviously, modifications and alterations will occur to others upon the reading and understanding of this specification. It is intended to include all such modifications and alterations insofar as they come within the scope of the appended claims or the equivalents thereof.

What is claimed is:

1. In a self-locking cable tie including a ladder-like band part (6) and a head part (1) having a passage opening (8) carrying a holding projection (2) adapted to engage in an opening (4) in the band part (6) and at least one guide element (7) lying on the side of the opening opposite the projection (2) and provided with a guide track for the band part (6) the improvement wherein said holding projection (2) comprises a rigid holding base portion (2') and a resilient outer free end portion (2') which extends outwardly from the base portion toward the guide track and wherein the guide track includes spaced rigid knobs (3', 3') which extend into said passage opening and which are displaced laterally on opposite sides of the resilient free end portion (2') at a location inwardly of the holding portion 2" relative to the entrance end of the passage opening (8), the relationship between said resilient outer free end portion and said rigid knobs being such as to direct said ladder-like band part into engagement with said rigid holding base portion when an attempt is made to withdraw said band part from said opening.

2. The self-locking cable tie of claim 1 wherein the knobs (3'; 3') define guide surfaces (7) lying in a plane for guiding the band part (6) relative to the holding projection (2) and wherein the free end portion (2') projects diagonally toward the plane of said guide surface (7).

3. The self-locking cable tie of claim 2 wherein said passage opening (8) has a width substantially equal to the width of said band.

* * * * *

UNITED STATES PATENT AND TRADEMARK OFFICE

CERTIFICATE OF CORRECTION

PATENT NO. : 4,788,752

DATED : Dec. 6, 1988

INVENTOR(S) : Kraus, et al.

It is certified that error appears in the above—identified patent and that said Letters Patent is hereby corrected as shown below:

Column 2, line 62 reading "inflexible rear zone 2'" should read ---inflexible rear zone 2"---. Column 3, lines 4, 9, 11, 21, 24, and 38 reading "3' and 3'" should all read ---3' and 3"---. Column 4, line 22, for the claim reference numeral "2'" should read ---2"---. Column 4, lines 25 and 36 reading "(3',3')" and (3';3') should both read ---(3',3")---.

Signed and Sealed this

Twenty-fifth Day of April, 1989

*Attest:*

DONALD J. QUIGG

*Attesting Officer*

*Commissioner of Patents and Trademarks*